US005354151A

United States Patent [19]

Giannesini

[11] Patent Number: 5,354,151

[45] Date of Patent: Oct. 11, 1994

[54] SYSTEM FOR LOADING AT SEA

[75] Inventor: Jean-François Giannesini, Saint Cloud, France

[73] Assignee: Institut Francais du Petrole, Rueil Malmaison, France

[21] Appl. No.: 924,050

[22] PCT Filed: Dec. 19, 1991

[86] PCT No.: PCT/FR91/01034

§ 371 Date: Oct. 28, 1992
§ 102(e) Date: Oct. 28, 1992

[87] PCT Pub. No.: WO92/12045
PCT Pub. Date: Jul. 23, 1992

[30] Foreign Application Priority Data

Dec. 28, 1990 [FR] France ..... 90 16440

[51] Int. Cl.[5] ..... E02D 23/02; E02D 27/38

[52] U.S. Cl. ..... 405/205; 405/210; 405/211; 405/224.3

[58] Field of Search ..... 405/210, 211, 217, 205, 405/204, 203, 200, 224.3, 224.2

[56] References Cited

U.S. PATENT DOCUMENTS 3,455,114 7/1969 Burrus .
3,664,388 5/1972 Frankel .
3,677,310 7/1972 Dobler et al. .
4,279,543 7/1981 Remery ..... 405/210 X
4,391,332 7/1983 Fayren ..... 405/224.3 X
4,402,632 9/1983 Cook ..... 405/210
4,673,313 6/1987 Baugh et al. ..... 405/224.3
4,907,912 3/1990 Smith ..... 405/200 X
5,069,580 12/1991 Herwig et al. ..... 405/203 X

FOREIGN PATENT DOCUMENTS 3117203 4/1981 Fed. Rep. of Germany .

*Primary Examiner*—Randolph A. Reese
*Assistant Examiner*—J. Russell McBee
*Attorney, Agent, or Firm*—Antonelli, Terry, Stout & Kraus

[57] ABSTRACT

System for loading at sea comprising a submersible conveying structure and anchoring device for the conveying structure. The loading system includes a bottom or base structure disposed on a sea bed and a maneuvering arrangement for bringing the conveying structure into a receptacle provided in the bottom or base structure.

13 Claims, 3 Drawing Sheets

SYSTEM FOR LOADING AT SEA

FIELD OF THE INVENTION

The invention relates to a system for loading at sea, more specifically for arctic and subarctic regions.

BACKGROUND OF THE INVENTION

Systems of this kind comprise a conveying structure for underwater production which makes it possible to bring the contents of an underwater reservoir or pipeline to a vessel to take it away, such as an oil tanker. All of the elements of this system must have structures that are resistant to icebergs and ice floes due to the layer of ice that covers certain areas periodically, or must be removed from the surface when the weather conditions at sea become too rough.

Usually, oil tankers are loaded at sea using a permanent anchorage consisting of a buoy anchored by chains or any combination of chains and cables. Loading is accomplished through a flexible pipe connecting the underwater reservoir, or the pipeline, to the buoy or directly to the ship being loaded. All of these loading stations are characterized by the permanent presence of an object located at the surface or in the immediately adjacent subsurface area (about 10 m beneath the surface of the ocean).

In oceans that are exposed to ice or to floes, such anchorages are destroyed immediately when they encounter an ice floe, or even when they are trapped in surface ice. Even if the buoy is designed to withstand the pressure of the ice locally, the total forces of interaction resulting from the drifting of ice floes at the anchorage are of such intensity that the mooring lines cannot resist it. It is therefore necessary to remove from the surface and from the subsurface all parts of the mooring system when there is a threat of ice or an encounter with an iceberg.

U.S. Pat. No. 4,650,431 describes a system allowing rapid disconnection of a ship being loaded from the transfer structure, with the pipes or tubes permitting the transfer of the output to the loading vessel being immersed at a level beneath the zone of turbulence or ice formation on the sea, yet at a certain height relative to the ocean bottom so that the flexible lines are not damaged by resting on the ocean bottom. This system has the disadvantage of leaving the flexible lines within the reach of icebergs, and the latter can have a considerable draft.

The document entitled "Sols for Floating Production Systems" issued during the conference entitled "Floating Production Systems" held in London on Dec. 11–12, 1989 describes a system which does not require any object at the surface to transfer production to a vessel, but which suffers from two serious disadvantages: it requires tankers with dynamic positioning and special equipment, said vessels having to be equipped with a specific system for loading, which requires these vessels to be dedicated to this operation. The multiplicity of loading systems on each vessel thus makes the economic feasibility of the system doubtful.

SUMMARY OF THE INVENTION

The goal of our invention is to remedy the disadvantages associated with previous systems and to suggest a less expensive system which does not leave any object exposed to any disturbing elements such as icebergs, violent storms, or any other weather event at sea that could damage one of the elements constituting a loading system.

This goal is achieved by virtue of the fact that the system for loading at sea, described in the present application, comprises a conveying structure such as a buoy, means for anchoring the conveying structure characterized by the conveying structure being submersible and by the system comprising a bottom structure itself comprising a receptacle for the conveying structure and by comprising means for maneuvering the conveying structure, said maneuvering means or guiding means being designed to move the conveying structure so as to insert it into the receptacle.

The above bottom structure can be composed of at least one underwater reservoir.

The system can comprise means for conveying the liquid cargo contained in said reservoir to a floating loading structure, such as a vessel.

The conveying means can comprise a conveying structure and means for connecting and/or disconnecting the floating structure and the conveying structure.

The bottom structure can be located in an excavation made in the ocean floor, or mounted on the ocean floor and surrounded by an artificial protective embankment. In these two cases, the receptacle is formed by a depression in the top of the bottom structure.

The bottom structure can be constituted by juxtaposing at least two underwater reservoirs to form an empty space located in the middle of the assembly thus formed.

The maneuvering means can comprise ballasting means.

The maneuvering means can comprise a mechanical device such as a winch.

The conveying means for the liquid cargo can be formed by flexible lines connected to the conveying structure through a rotating joint.

The anchoring means can be lines such as chains weighted at their upper ends to facilitate guiding the buoy into the receptacle.

The advantage which the invention described in this document offers is a less clumsy system that makes it possible to shelter all the elements usually constituting loading stations.

The present invention will be better understood and other goals, characteristics, details, and advantages thereof will be clearer from the explanatory description which follows, with reference to the attached schematic diagrams provided solely as examples. wherein:

DETAILED DESCRIPTION

Figure 1:
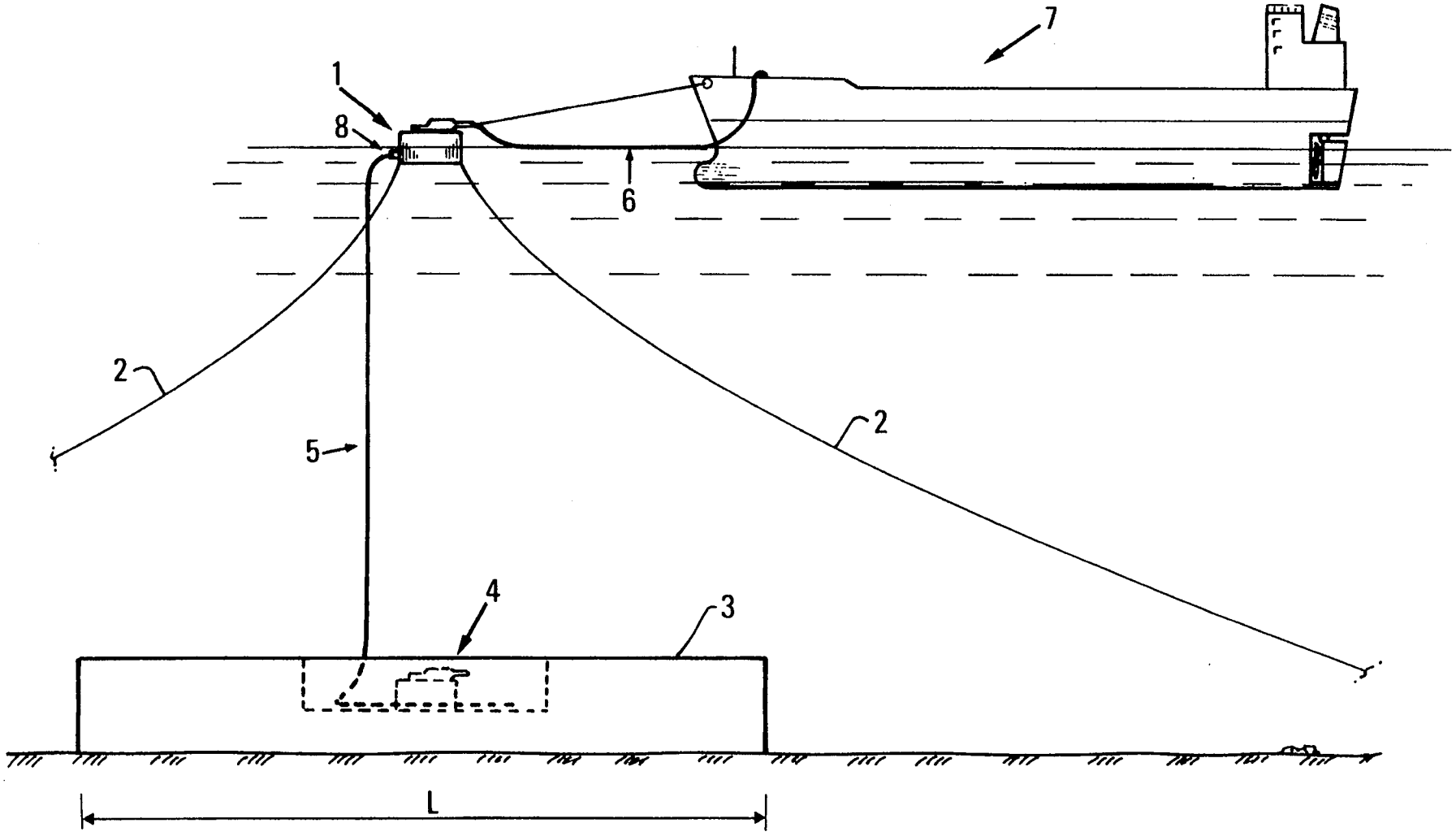
FIG. 1 is a general view of a conveying system constructed in accordance with one of the embodiments of the invention, showing the system in an operating state and, using dotted lines, the system when the conveying structure has been sheltered from all disturbing elements.

FIG. 1 shows a conveying system according to the present invention, comprising a submersible conveying structure 1, or submersible buoy, normally floating at the surface of the ocean. The conveying structure is anchored on the ocean floor by a group of anchor lines 2 (at least 3 lines) which can be cables or chains, or any combination of chains and cables with elements such as floats or weights. In the event of a threat posed by a drifting iceberg or ice at the surface of the ocean, the buoy is submerged in a receptacle 4 in underwater reservoir 3.

The buoy can be provided with an arm and floating cable which is recovered by the vessel to moor it. Usually the arm can rotate around the vertical axis of the buoy, permitting the vessel to orient itself in the direction that offers the least resistance to the action of marine factors (swell, wind, current), aligning itself in the appropriate direction.

The receptacle can be formed by a local depression in the top of the underwater reservoir. The depth of this depression is such that the buoy and its accessories do not project beyond the top of the reservoir when the assembly is located in the receptacle. The depth will be determined preferably on the basis of the height of the buoy and its accessories, adding an extra 1 to 2 m as a safety margin. In this fashion, the iceberg passing over the reservoir will not pose the risk of damaging the buoy or its equipment when the latter is in the receptacle.

The horizontal dimensions of the receptacle comprising the buoy shelter are calculated taking into account the horizontal dimensions of the buoy and the horizontal displacement of its axis during the ballasting operation when it is subjected to the action of the current. This horizontal displacement is limited by the action of the anchor lines. In view of the stiffening effects which these lines impose on the mooring buoys, it has been found that the maximum difference planewise which the buoy undergoes relative to its initial reference position remains compatible with the dimensions of the reservoirs down to depths on the order of 120 to 150 m. For a depth of 100 m, one may expect a maximum difference on the order of 15 to 20 m with respect to conventional systems. It is therefore sufficient for the diameter of the receptacle to be slightly more than twice this difference, plus the diameter of the buoy and its accessories, in other words on the order of 10 to 20 m (with the buoys being considered for the sake of this application to have diameters on the order of 5 m) in order for the buoy to be able to fit into its shelter naturally during the submersion process.

The diameter of the receptacle must therefore be on the order of 40 to 45 m, which is perfectly compatible with the dimensions of the underwater reservoirs, which can reach horizontal dimensions of 100 m and vertical heights of at least 10 to 20 m. A specific example is provided later on in the specification.

It will not constitute a departure from the present invention if the bottom structure forming the shelter does not have the function of a reservoir but any other function, even the sole function of serving as a receptacle for the buoy.

Loading can be performed using a pipeline.

Loading is carried out by a flexible line 5 linking reservoir 3 to buoy 1. A second flexible line 6 generally attached to the cable or parallel thereto, connects buoy 1 to vessel 7. The passage through the rotating arm is accomplished by a special rotating joint, known in the prior art.

It will not constitute a departure from the present invention to use a flexible line that allows the production from the reservoir to reach the vessel directly. In this case, a line used for the ballasting operation connects the bottom structure to the buoy. In this case, it is not necessary for the latter to have a rotating arm. This application might be envisaged for a sheltered location near a coast.

The flexible conduit normally functions as long as it is not exposed to extremely sharp bending or excessive stress, especially at the point where it is attached to the conveying structure. The flexible lines used in the present invention have the special feature of being readily recoverable once they are left on the ocean floor and, during the descent of the buoy into the receptacle, of arranging themselves naturally without knotting. They therefore come to rest in the receptacle as the buoy is fitted into the receptacle. The connecting point between a flexible line and the conveying structure is provided by a rotating joint of the type usually used to transfer high pressure fluids, allowing the flexible line to position itself naturally and not to impose stresses that could damage it when the buoy reaches its final position in the receptacle.

The maneuvering means that make it possible to position the buoy in the bottom structure comprise a flexible line and at least one ballasting compartment in the buoy.

When the weather conditions at sea require it, the buoy is immersed by ballasting the compartments with sea water. The buoy can be composed of two types of compartments. The first category is constituted by compartments of the same kind as in traditional buoys, which are always empty or filled with a light filling material for safety's sake. The second category is constituted by ballasting compartments that can be empty or filled with sea water or any other fluid making it possible to ballast the buoy. The respective volumes of these two compartments are calculated so that the buoy normally floats at the surface, supporting its anchorage when the ballastable compartments are empty, and by having an apparent weight that is slightly positive, without the anchorage weight, when resting in the receptacle.

Beginning with the normal floating situation, submersion is accomplished for example by introducing seawater into the ballastable compartments, for example by pumping. Thus, the maneuvering means of the buoy can comprise a pump and a line for feeding sea water into the ballastable compartments.

Figure 2:
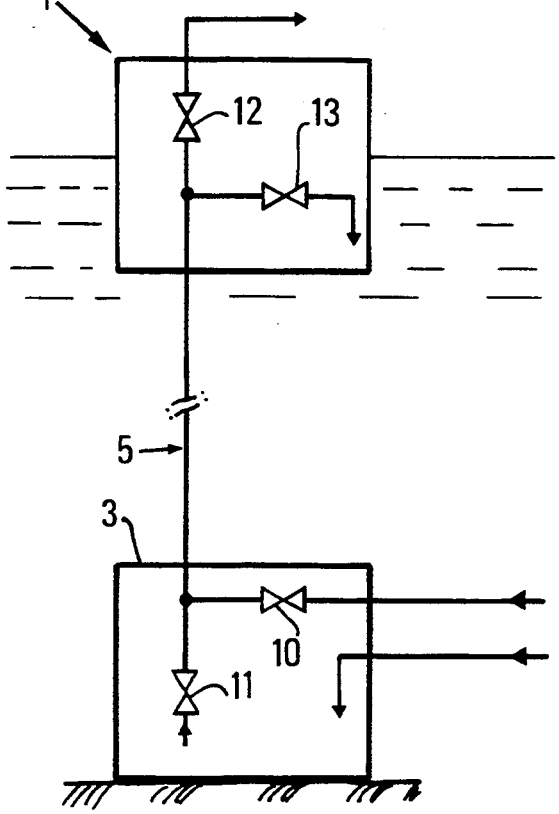
FIG. 2 is a schematic representation of the valve system with which the flexible line is equipped when the latter is also used as a ballasting line.

In a first embodiment, the pump is located on the ocean floor or on the underwater reservoir. A flexible line connects the reservoir and the buoy. This flexible line can be the flexible conveying line 5 of the vessel. In this case, it is equipped with remote controlled isolating valves at each end, shown schematically in FIG. 2, which make it possible to use said line 5 alternatively for ballasting the buoy or for loading the vessel. When line 5 acts as a loading line, valves 11 and 12 are open to allow the liquid from the reservoir to go to the vessel being loaded. During the ballasting operation, valves 11 and 12 are closed, valve 10 is open to allow the sea water to enter flexible line 5, and then, when valve 13 opens, to enter one of the hallasting compartments. The operation is reversed as far as the openings and closings of the valves are concerned when a shift is made to the loading operation for a vessel. Remote controlled lines for the ballasting or loading operations are associated with the flexible ballasting line.

This arrangement nevertheless suffers from one disadvantage, namely that it is necessary to drain and clean the line when recovering and treating the water ballast after each filling of the vessel to prevent contaminating the water ballast dumped into the ocean. A second flexible line is therefore used, dedicated to ballasting, said line having properties identical to those of loading line 5 described above. This second line can be made integral with the first, over all or at least a part of its length.

As the water is introduced into the ballast compartments, the buoy becomes heavy and sinks. The sinking of the buoy can be controlled by the weights on the anchor lines. As the buoy sinks, a greater length of each anchor line rests on the bottom.

The length that is suspended decreases at the same time and so does its weight. As a result a stable depth can be found for every amount of liquid introduced according to the known principle of the guide rope used in balloons. In this manner, the buoy will come down gently on the bottom without an excessive impact speed, with the rotating joint keeping the flexible line from being damaged when the buoy is in its final position in the receptacle.

In a first embodiment, air is trapped under pressure in the reservoirs during the ballasting operation. In this case, evacuation of the water ballast by opening a valve to the sea allows flushing the sea water and causing the assembly to rise to the surface when weather conditions at sea become more favorable.

Another procedure entails maintaining a nearly constant pressure by evacuating the air as the water is introduced into the compartments. Deballasting is then accomplished by introducing compressed air. The system is then equipped with a line that allows air to be added or removed, said line possibly being integral with the flexible line for loading or ballasting.

Another variation consists in using the combination of water and oil to make the buoy alternately heavier and lighter. This embodiment makes it possible to minimize the pressure differences that act on the walls of the buoy and reduce the loss of stability using the liquid hull effect. In this case, the buoy structure is designed with ballast compartments whose volumes are larger than for the water-air combination.

Figure 3A:
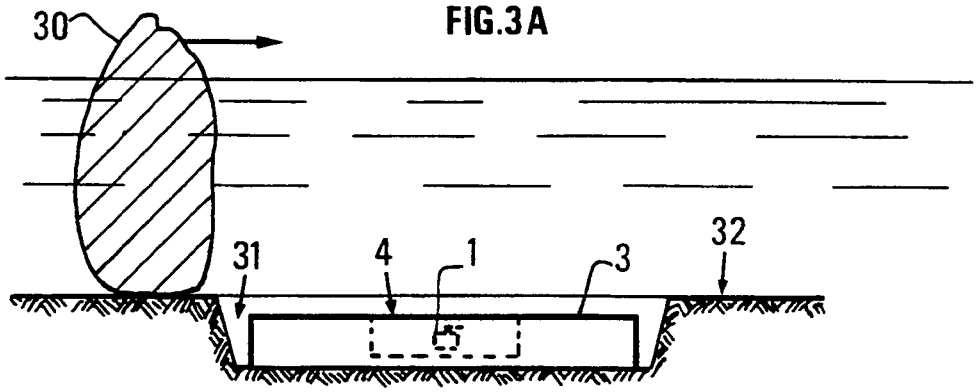
FIGS. 3A and 3B show two positions which the bottom structure can occupy on the ocean floor and the depression which it has in its top.
Figure 3B:
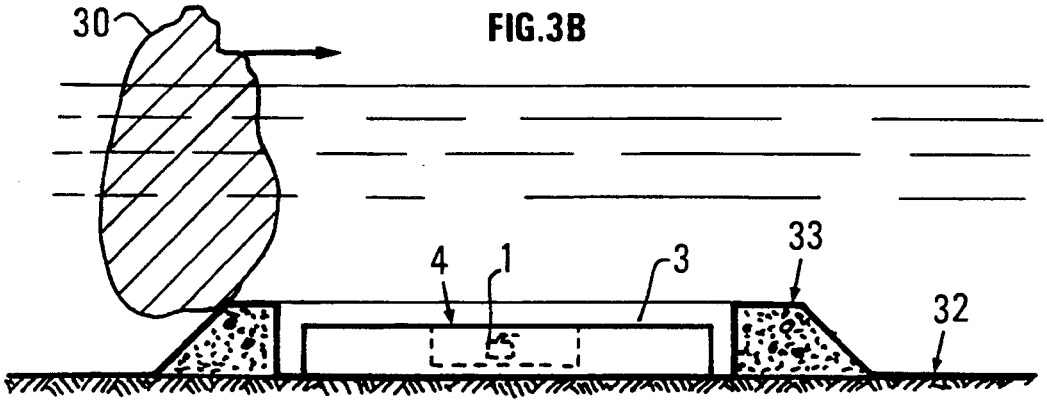

FIGS. 3A and 3B describe two possible positions for the bottom structure. FIG. 3A shows underwater reservoir 3 located in an excavation 31 formed in ocean floor 32 so that the underwater reservoir is protected from possible impacts by icebergs 30.

FIG. 3B shows underwater reservoir 3 located on ocean floor 32 and surrounded by artificial protective embankment 33 which stops icebergs whose draft is too great. This embankment can be constructed by dumping granular materials such as sand, pieces of concrete, or other material performing the same function. The dumping is carried out from a vessel or by dredging the ocean floor in the immediate vicinity of the reservoir.

Another possibility is to use a structure that is sufficiently strong to withstand the impact of an iceberg without damage, eliminating the need to construct a protective embankment.

Figure 4A:
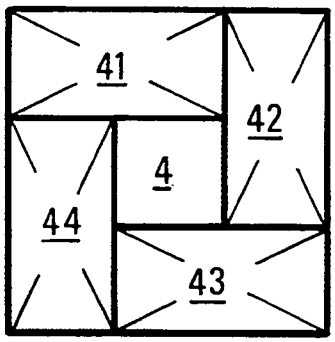
FIGS. 4A and 4B show a bottom structure formed by juxtaposing reservoirs.
Figure 4B:
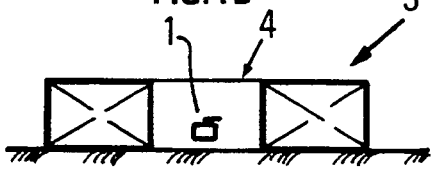

FIGS. 4A and 4B show in a plane view and in cross section one possible arrangement of four reservoir elements forming an empty space in their center. The reservoir is constituted by juxtaposing elements 41, 42, 43, and 44 arranged to form an empty space or receptacle 4 for the buoy in the middle of the assembly.

In the case of FIGS. 4A and 4B the elements have rectangular shapes but it is also possible to use any other shape. The number of elements constituting the structure depends on its shape. The assembly is submerged side-by-side at the surface and the elements are connected together by pipes.

This construction method reduces the dimensions of the units to be moved and facilitates the operations that must be conducted.

This arrangement also makes it possible to protect all the other underwater equipment likely to sustain an impact, such as pipes, valves, etc.

The elements that form the shelter can have a function other than serving as a reservoir, or they can have the sole function of serving as a receptacle for the buoy.

Another variation consists in mounting the pump on the buoy. In this case the flexible ballasting line is replaced by an electric cable that provides the energy to a motor driving the pump. The motor and pump are then located in a sealed compartment on the buoy to avoid any problems occurring when the buoy is submerged.

Figure 5:
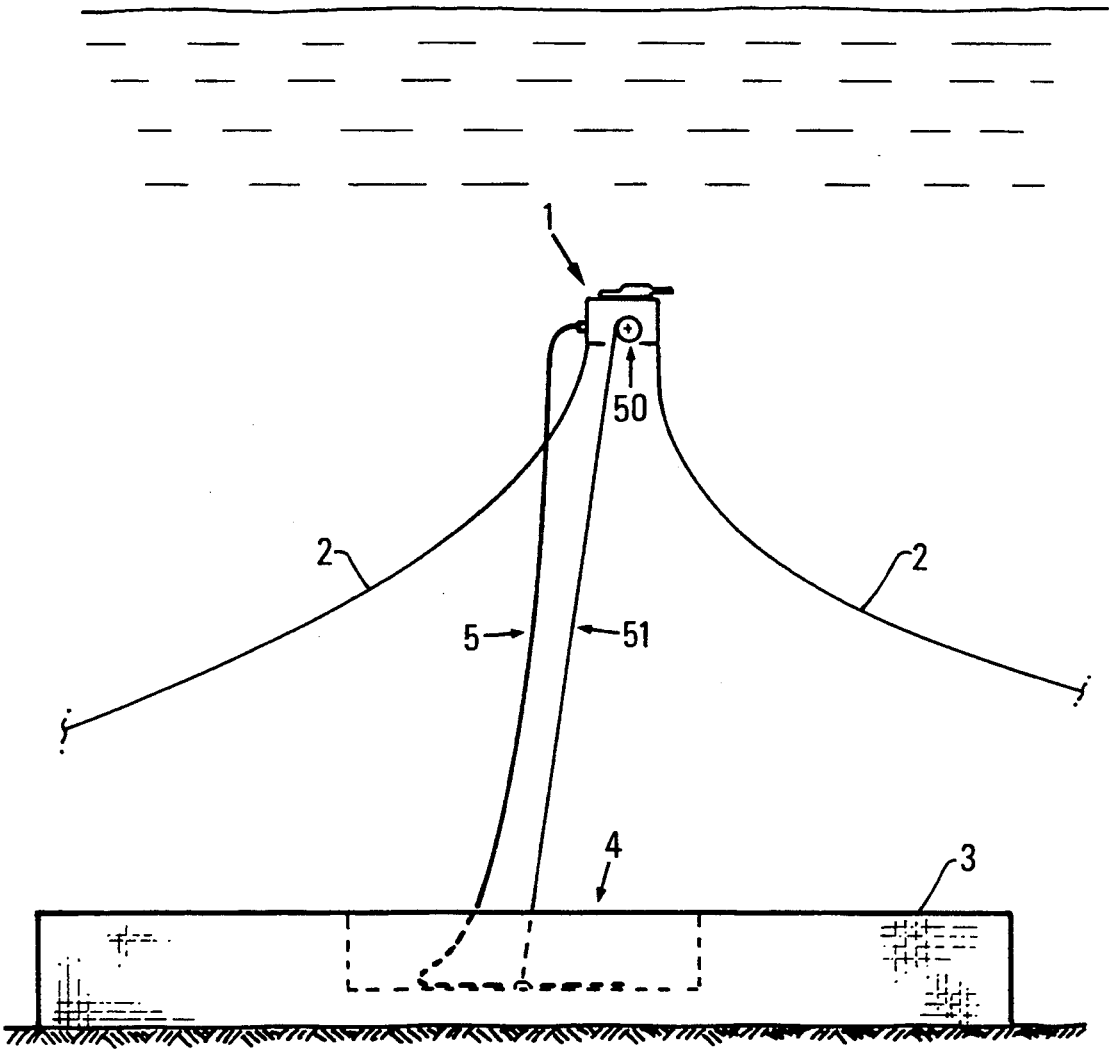
FIG. 5 is a variation on the system described above, wherein the maneuvering means comprise a winch.

FIG. 5 shows another embodiment of the system in which the maneuvering means comprise a winch 50. Elements common to the system described in FIG. 1 have the same reference numerals.

In particular, in the case when the anchoring means are insufficient to guide the buoy from the surface to its final position in receptacle 4, for example under unfavorable weather conditions at sea, the system comprises a winch that allows the buoy to be lowered into the receptacle. Winch 50 is preferably located in a recess in buoy 1 for reasons of ease of maintenance and repair. This example is not a limitation; winch 50 can be located on the buoy or on the reservoir.

The winch pulls a cable 51 located between buoy 1 and reservoir 3 with constant tension. The tension on cable 51 is determined as a function of the horizontal forces likely to be acting on the buoy.

It will not constitute a departure from the present invention for the maneuvering system to comprise a plurality of winches.

A numerical example provides a concrete description of the functioning of the system described above, namely the possibility of causing the submersible buoy to arrive in the receptacle of the bottom structure under the sole guidance of the anchor lines, with severe weather conditions at sea, with the speed of the current near the bottom being 0.5 m/sec, a value greater than the usual order of magnitude of such speeds.

The following data are representative of an anchorage for a loading system:

| | |
|---|---|
| Water depth | 100 m |
| Buoy: | |
| diameter | 10 m |
| height | 5 m |
| Number of anchor lines | 6, regularly distributed |
| Type | 4 inches, grade U3 |
| Breaking stress | 7320 kN |
| Apparent weight of lines in water | 1.97 kN/m |
| Pretensioning of lines | 700 kN |

-continued

| | |
|---|---|
| Speed of current near bottom: | 0.5 m/sec |

Considering a buried reservoir like that shown in FIG. 3A. The cases in FIG. 1 and FIG. 3B are more favorable.

Assuming that the length of the lines is 850 m, nearly corresponding to the raised length when the breaking stress is reached. The horizontal distance projected between the point of attachment to the buoy and the anchor is then 822.35 m to obtain a pretensioning of 70 kN.

This distance of 822.35 m is obtained by using the familiar formulas for catenary curves, correcting the initial length of the line to account for its elongation under the initial pretensioning of 70 kN. Thus a length of approximately 850.27 m is obtained after the tension is applied.

The catenary formulas give the raised length s of the line by the formula:

$$s = \sqrt{d^2 + 2da}$$

where d is the vertical distance from the point of contact with the bottom to the end, here equal to the depth of the water and a is the catenary parameter:

$$a = \frac{H}{\omega} = \frac{T - \omega d}{\omega}$$

where H is the horizontal component of the tension T at the end and $\omega$ is the linear weight of the line. We therefore obtain:

H=503 kN a=255.3 m.

$$s = \sqrt{100^2 + 2 \times 100 \times 255{,}3} = 247{,}11 \text{ m}$$

A length which is not elevated remains on the bottom, equal to 850.27−247.11 or 603.16 m.

The horizontal distance x corresponding to the raised part of the line is obtained by the following formula:

$$s = a\, sh\left(\frac{x}{a}\right)$$

so that x can be calculated to be 219.19 m, with a total horizontal distance of 603.16+219.19 or 822.35 m.

The distance of the anchors from the axis of the buoy in its initial position and from its seat is therefore:

$$d_o = 822{,}35 + \frac{10}{2} = 827{,}35 \text{ m}$$

taking into account the radius of the buoy.

When the line is entirely resting on the bottom, it exceeds the axis of the seat by 850−827.35 or 22.65 m.

Figure 6:
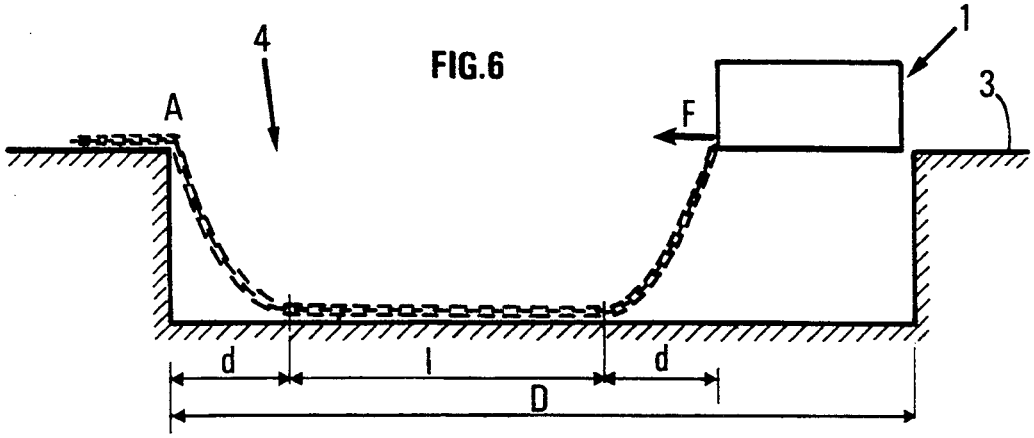
FIG. 6 shows in one specific case how the buoy is inserted into the receptacle.

Let us consider a circular recess 42 m in diameter (D) and 10 m deep in the buoy [sic]. The distance from the end of this line to point A in FIG. 6, located at right angles [sic] to the point on the receptacle closest to the anchor, is therefore 22.65 +21 or 43.65 m.

The lateral forces that tend to move the buoy off the recess axis are produced mainly by the dragging forces of the current:

$$F \cong \frac{1}{2}\rho S C_d V^2 = \frac{1}{2} \times 1{,}025 \times 10 \times 5 \times 1{,}0 \times 0{,}5^2 = 6{,}5 \text{ kN}$$

To simplify this, we will consider that a single chain exerts the returning movement.

The suspended weight of the chain makes it possible to keep the buoy inside the recess.

The catenary formulas then give the following:

H=$\omega$a=6.5 kN where $\omega$=linear weight of the chain and a=catenary parameter.

$$a = 6.5/1.97 = 3.30.$$

$$d = a\left(ch\frac{x}{a}\ 1\right) \qquad x = 6{,}83 \text{ m}$$

$$s = a\, sh\frac{x}{a} \qquad s = 12{,}88 \text{ m}$$

When the buoy arrives at the level of the top of the reservoir, it has two symmetrical catenary arcs 12.88 m in length, separated by a segment with a length of 43.65−2×12.88 or 17.89 m=1.

The horizontal projection of the line has a length of:

$$6.83 \times 2 + 17.89 = 31.6 \text{ m}.$$

The point on the buoy diametrically opposite is located at 31.6+10.0=41.6 m, or 0.4 m inside the closest point of the recess.

Therefore the two lines adjacent to the line that is stretched the most will themselves also contribute to exerting a returning force.

To facilitate the insertion of the buoy into its recess, the anchor chains can be weighted at their upper ends over about 40 m, for example by using a 5" or 6" chain.

I claim:

1. Loading system for transferring a fluid from a bottom structure positioned on a sea bed to a submersible transfer structure comprising means for anchoring said transfer structure, means for maneuvering said transfer structure to said bottom structure, said bottom structure comprising a receptacle, wherein said maneuvering means includes said anchoring means connected to a floating structure and ballasting means located between said transfer structure and said bottom structure, said anchoring means and said ballasting means being constructed so as to enable a displacement of said transfer structure into the receptacle of said bottom structure.

2. Loading system according to claim 1, wherein said bottom structure is located in an excavation in an ocean bottom.

3. Loading system according to claim 1, wherein said bottom structure includes at least one underwater reservoir.

4. Loading system according to claim 3, wherein conveying means are adapted to transport liquid cargo contained in said reservoir to a floating loading structure.

5. Loading system according to claim 4, wherein said conveying means includes flexible lines connected to the transfer structure through a rotating joint.

6. Loading system according to claim 4, wherein the conveying means includes a conveying structure and means for enabling one of connecting or disconnecting of the conveying structure from said floating structure.

7. Loading system according to one of claims 2 or 6, wherein said receptacle is formed by a depression in a top of the bottom structure.

8. Loading system according to one of claims 1 or 3, wherein said bottom structure is constituted by a juxtaposition of at least two submerged reservoirs forming an empty space located in a middle of the assembly thus formed.

9. Loading system according to one of claims 1 or 3, wherein said means for maneuvering comprises a mechanical device.

10. A loading system according to claim 9, wherein the mechanical device includes a winch.

11. Loading system according to claim 1, wherein said bottom structure is placed on the ocean floor and is surrounded by an artificial protective embankment.

12. Loading system according to claim 1, wherein said anchoring means includes anchoring lines weighted at upper ends thereof.

13. Loading system according to claim 1, wherein the anchoring means includes a plurality of flexible lines having a weight selected so as to control a horizontal movement of the transfer structure when the anchoring means is lowered.

* * * * *